US007794245B2

(12) United States Patent
Thompson

(10) Patent No.: US 7,794,245 B2
(45) Date of Patent: Sep. 14, 2010

(54) UNIVERSAL PROTECTION COVER CAP FOR A USB PLUG

(76) Inventor: Brian J. Thompson, 17238 Haley Falls La., Houston, TX (US) 77095

( * ) Notice: Subject to any disclaimer, the term of this patent is extended or adjusted under 35 U.S.C. 154(b) by 0 days.

(21) Appl. No.: 12/074,808

(22) Filed: Mar. 6, 2008

(65) Prior Publication Data

US 2009/0227155 A1 Sep. 10, 2009

(51) Int. Cl.
*H01R 13/44* (2006.01)

(52) U.S. Cl. ..... 439/135

(58) Field of Classification Search ..... 439/135, 439/134

See application file for complete search history.

(56) References Cited

U.S. PATENT DOCUMENTS

| | | | | |
|---|---|---|---|---|
| 6,456,500 | B1 * | 9/2002 | Chen | 361/752 |
| 6,522,534 | B1 * | 2/2003 | Wu | 361/686 |
| 6,612,853 | B2 * | 9/2003 | Wu | 439/136 |
| 6,618,243 | B1 * | 9/2003 | Tirosh | 361/683 |
| 6,652,297 | B1 * | 11/2003 | Zhang et al. | 439/136 |
| 6,733,329 | B2 * | 5/2004 | Yang | 439/518 |
| 6,763,410 | B2 * | 7/2004 | Yu | 710/74 |
| 6,905,352 | B2 * | 6/2005 | Chao | 439/135 |
| 6,999,322 | B1 * | 2/2006 | Lin | 361/752 |
| D521,509 | S * | 5/2006 | Chen | D14/480.5 |
| 7,153,148 | B2 * | 12/2006 | Chen et al. | 439/141 |
| 7,214,075 | B2 * | 5/2007 | He et al. | 439/135 |
| 7,222,939 | B2 * | 5/2007 | Silverbrook et al. | 347/49 |
| 7,239,504 | B2 * | 7/2007 | Schlesener et al. | 361/681 |
| 7,241,153 | B2 * | 7/2007 | He et al. | 439/148 |
| 7,275,941 | B1 * | 10/2007 | Bushby | 439/133 |
| 7,341,464 | B2 * | 3/2008 | Cuellar et al. | 439/135 |
| 7,361,034 | B1 * | 4/2008 | Chiu et al. | 439/131 |
| 7,364,445 | B1 * | 4/2008 | Ni et al. | 439/140 |
| 7,394,661 | B2 * | 7/2008 | Wang et al. | 361/737 |
| 7,416,424 | B1 * | 8/2008 | Deckman | 439/135 |
| 7,422,454 | B1 * | 9/2008 | Tang et al. | 439/131 |
| 7,443,691 | B1 * | 10/2008 | Davis | 361/752 |
| 2005/0009388 | A1 * | 1/2005 | Chao | 439/135 |
| 2006/0131431 | A1 * | 6/2006 | Finn | 235/492 |
| 2007/0030442 | A1 * | 2/2007 | Howell et al. | 351/158 |
| 2007/0075146 | A1 * | 4/2007 | Yang | 235/492 |
| 2007/0159362 | A1 * | 7/2007 | Shen | 341/20 |

* cited by examiner

*Primary Examiner*—T C Patel
*Assistant Examiner*—Vladimir Imas
(74) *Attorney, Agent, or Firm*—Darcell Walker

(57) ABSTRACT

A USB cap cover has a conventional main body with an opening to engage the USB connector of a USB storage device. The USB cap of the present invention also contains an extension element that extends from at least one side of the open end of the USB cap. The extension element extends along and is relatively parallel to the surface of the USB storage device package. The surface of the extension member can be used to display information.

7 Claims, 8 Drawing Sheets

UNIVERSAL PROTECTION COVER CAP FOR A USB PLUG

FIELD OF THE INVENTION

This invention relates to a Universal Serial Bus memory storage device and in particular to a universal cap for a USB flash memory storage device.

BACKGROUND OF THE INVENTION

A Universal Serial Bus (USB) is a serial bus standard to interface devices. The USB was designed to allow peripherals to be connected using a single standardized interface socket and to improve plug-and-play capabilities by allowing devices to be connected and disconnected without rebooting the computer (hot swapping). Other convenient features include providing power to low-consumption devices without the need for an external power supply and allowing many devices to be used without requiring manufacturer specific, individual device drivers to be installed.

USB is intended to help retire all legacy varieties of serial and parallel ports. USB can connect computer peripherals such as mouse devices, keyboards, PDAs, gamepads and joysticks, scanners, digital cameras, printers, personal media players, and flash drives. For many of those devices USB has become the standard connection method. USB is also used extensively to connect non-networked printers; USB simplifies connecting several printers to one computer. As USB technology improves there are a large volume of USB memory devices, including flash memory devices.

USB flash drives are NAND-type flash memory data storage devices integrated with a USB (universal serial bus) connector. They are typically small, lightweight, removable and rewritable. USB Memory card readers are also available, whereby rather than being built-in, the memory is a removable flash memory card housed in what is otherwise a regular USB flash drive.

Although the flash drive comes in a compact packages, standard USB flash memory devices typically have several components. A male USB connector provides an interface to the host computer. A USB mass storage controller implements the USB host controller and provides a linear interface to block-oriented serial flash devices while hiding the complexities of block-orientation, block erasure, and wear levelling, or wear balancing. The controller contains a small RISC microprocessor and a small amount of on-chip ROM and RAM. A NAND flash memory chip stores data. NAND flash is typically also used in digital cameras. A crystal oscillator produces the device's main 12 MHz clock signal and controls the device's data output through a phase-locked loop. Jumpers and test pins for testing during the flash drive's manufacturing or loading code into the microprocessor. LEDs indicate data transfers or data reads and writes. Write-protect switches—indicate whether the device should be in "write-protection"

Another component of the USB flash drive is a USB connector cover or cap. This cap reduces the risk of damage due to static electricity, and improves overall device appearance. Some flash drives do not feature a cap, but instead have retractable USB connectors. Other flash drives have a "swivel" cap that is permanently connected to the drive itself and eliminates the chance of losing the cap.

Although the cap cover provides a main function of protecting the USB connector, the USB is capable of serving additional functions with regard to conveying information on the USB package. Despite the capability to display information on the USB package, there remains a need for USB cover cap that can also be used to display information.

SUMMARY OF THE INVENTION

The present invention is a universal cap/cover for a USB storage device. This device has a conventional main body with an opening to engage the USB connector of a USB storage device. The USB cap of the present invention also contains an extension element that extends from at least one side of the open end of the USB cap. The extension element extends along and is relatively parallel to the surface of the USB storage device package. The surface of the extension member can be used to display information

DETAILED DESCRIPTION OF THE INVENTION

Figure 1:
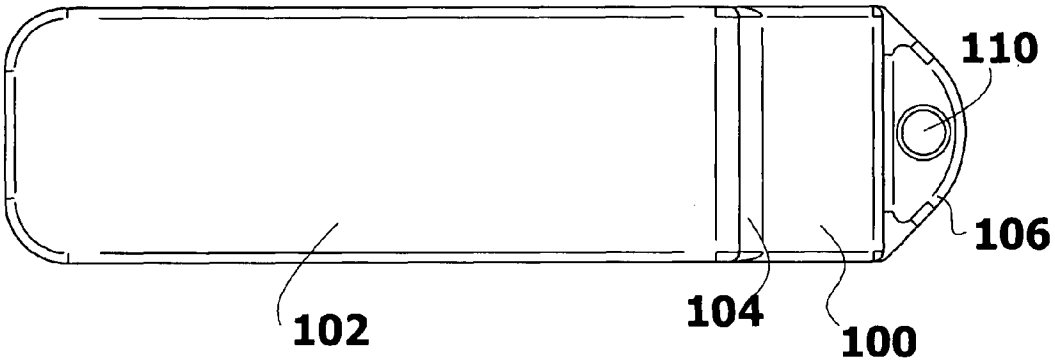
FIG. 1 displays a top view of the extension element of the present invention.
Figure 2:
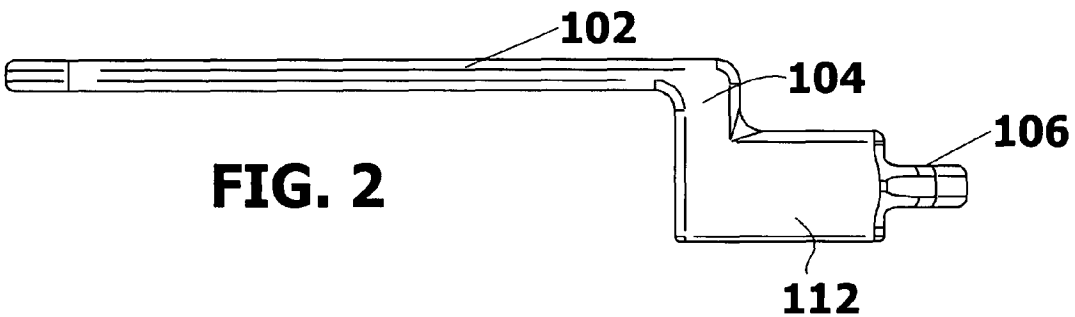
FIG. 2 displays a side view of the extension element of the present invention.
Figure 3:
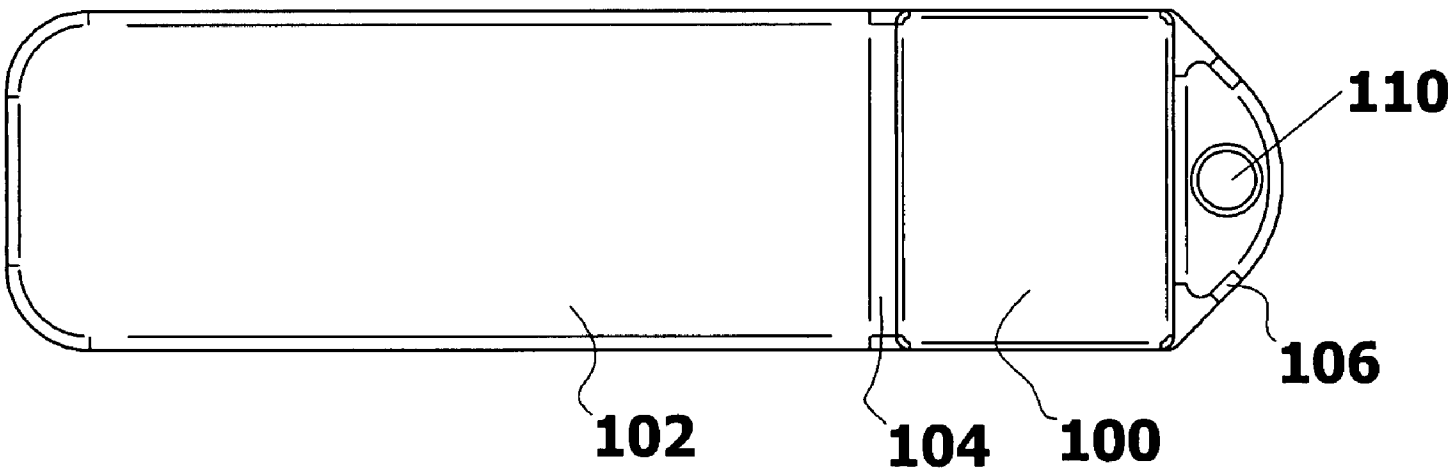
FIG. 3 displays a bottom view of the extension element of the present invention.

The present invention is a cap/cover for an USB memory device. FIG. 1 shows the topside of a cover according the present invention. The cover comprises a cap body 100 and a main extension 102. Also included is a bridge section 104 that connects the cap body and extension. As shown, is a handle extension 106 that extends from the cap body at the end of the cap body that is opposite the end from which the main extension 102 connects to the cap body. The handle extension can have an opening 110 in the service FIG. 2 shows a side view of the present invention. This view reflects the length of the USB cover of the present invention. The side of the cap body can have generally flat side surfaces 112. However, the cap body of the present invention can have various outer surface shapes. Also clearly shown is the bridge section 104 and the handle extension 106. FIG. 3 shows a bottom view of the cap of the present invention.

Figure 4:
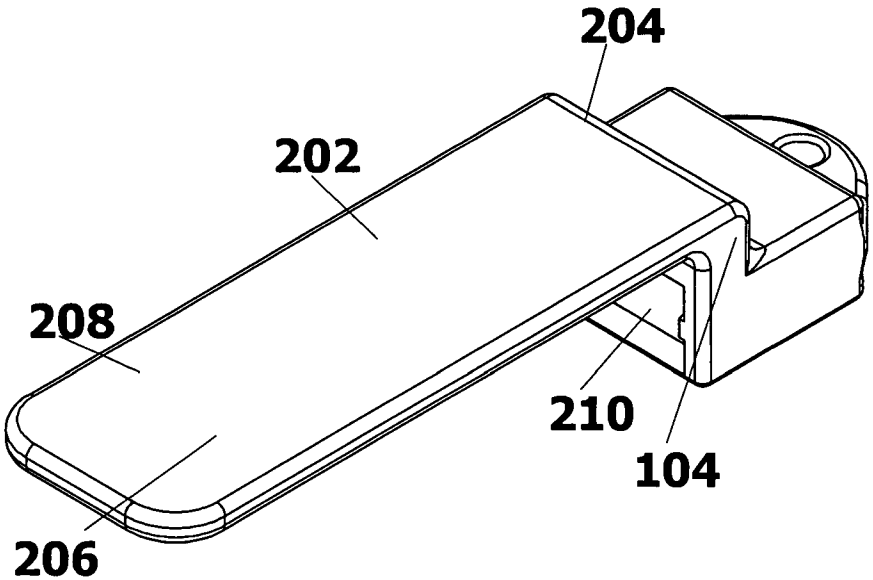
FIG. 4 displays a three-dimensional top view of the extension of the present invention.

FIG. 4 is a three-dimensional top, front and side view of the present invention. In this view, the cap has a generally rectangular shape. With regard to the extension, it has a rectangular shape with a generally flat top surface 202. This flat top surface can be used to display information related to the USB that the cap will cover. The information can relate to contents of a particular USB memory device, the name of the owner of the USB device or even some advertisement. The back edge 204 of the extension connects with the bridge section 104.

Figure 5:
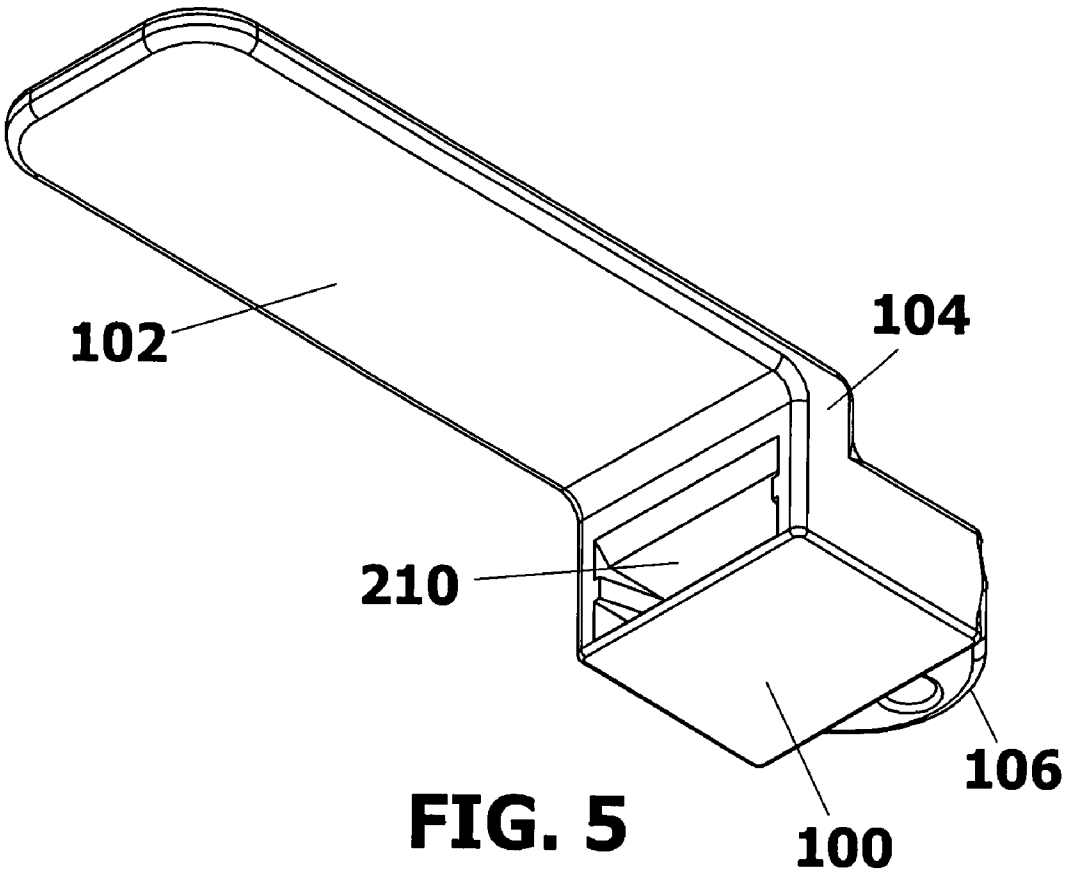
FIG. 5 displays a three-dimensional bottom view of the extension element of the present invention.

The front edge of the extension has a straight section 206 with rounded corners 208. As mentioned, this configuration is only one shape in which the extension of the present invention can be implemented. FIG. 5 shows a three-dimensional bottom, side and front of the extension of the present invention. As shown, the extension connects with the bridge section 104. Also shown is that the cap body 100 has an opening 210 under the main extension 102 opposite the closed end 230 of the cape body 100. This opening facilitates insertion of the USB connection into the cap cover.

Figure 6:
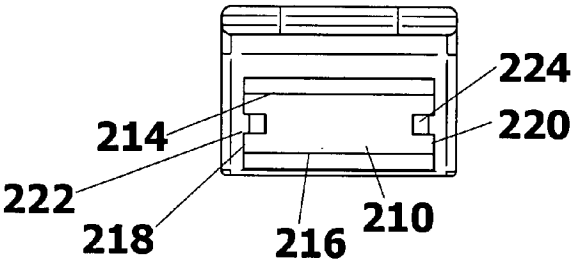
FIG. 6 is a front view of the internal configuration of the USB cap of the present invention.
Figure 7:
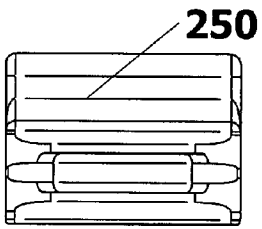
FIG. 7 is a back view of the internal configuration of the USB cap of the present invention.

FIGS. 6 and 7 show detailed features of the cap body of the present invention. With regard to FIG. 6, the opening 210 has a rectangular shape with top 214 and bottom 216 internal surfaces. Sides 218 and 220 have guides 222 and 224 that extend into the opening from the sides. The guides serve to position and secure the USB connection in the cap. FIG. 7 shows the closed end 230 on the back of the cap body opposite the opening 210 under the main extension 102. As previously described the extension handle 106 connects to this closed end of the cap body.

Figure 8:
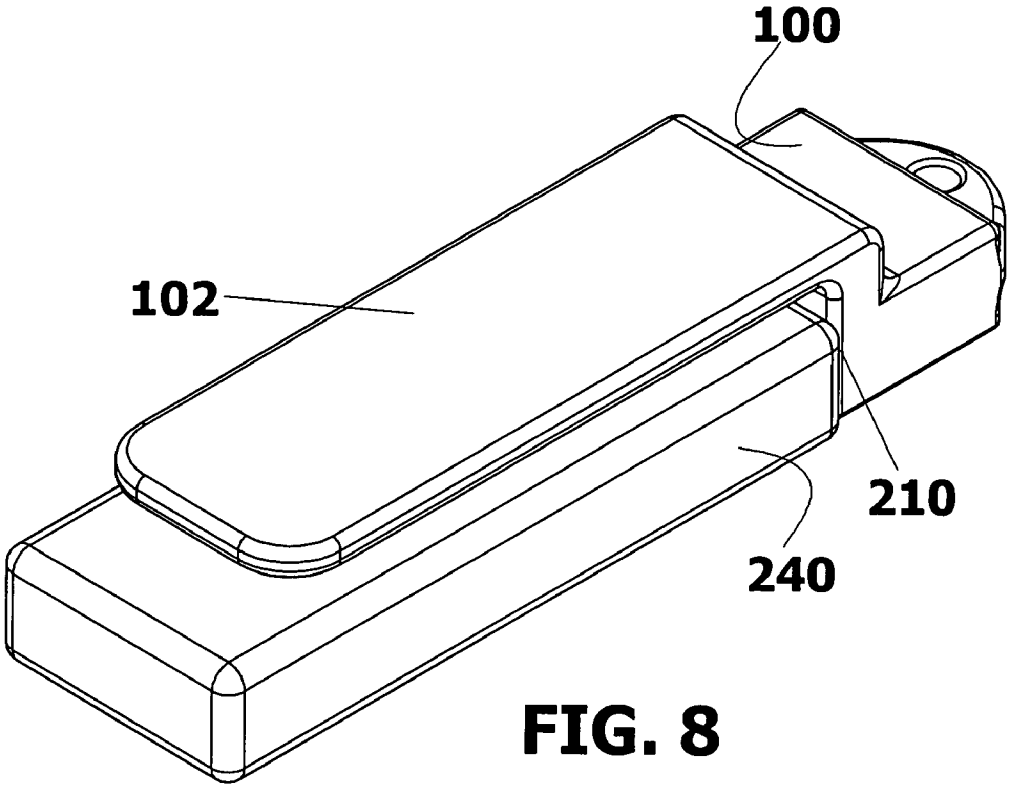
FIG. 8 is a three-dimensional top view of the extension element of the present invention attached to a USB flash memory device.
Figure 9:
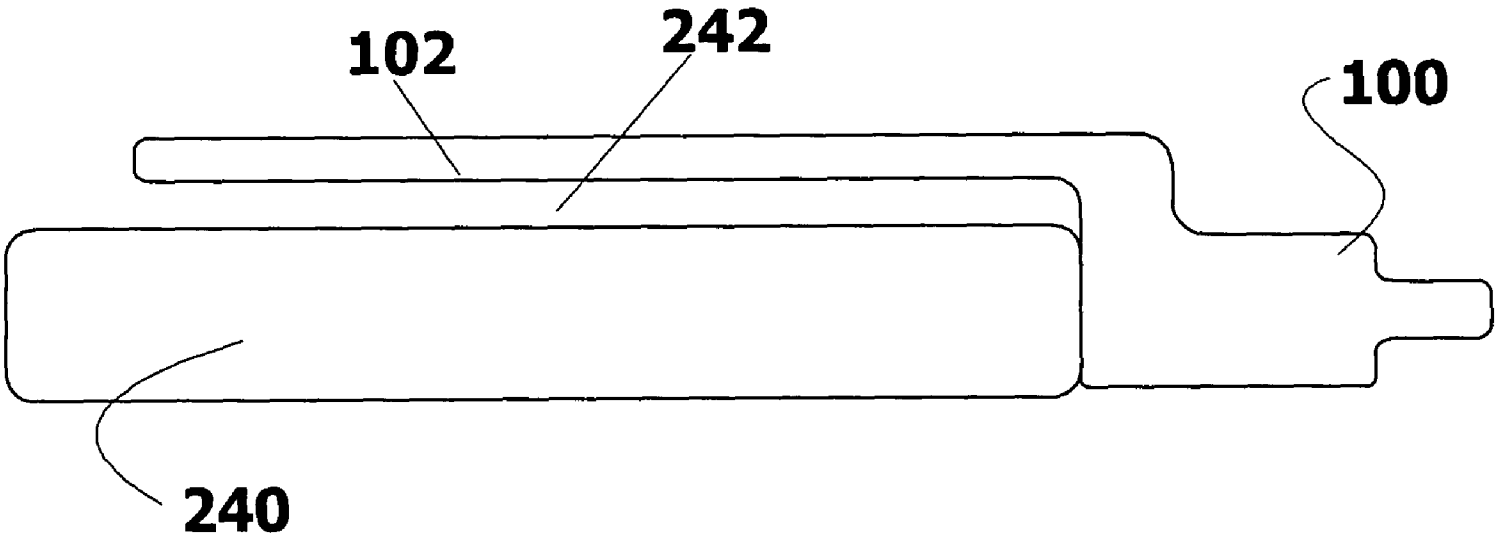
FIG. 9 is a side view of the extension element of the present invention attached to a USB flash memory device.
Figure 10:
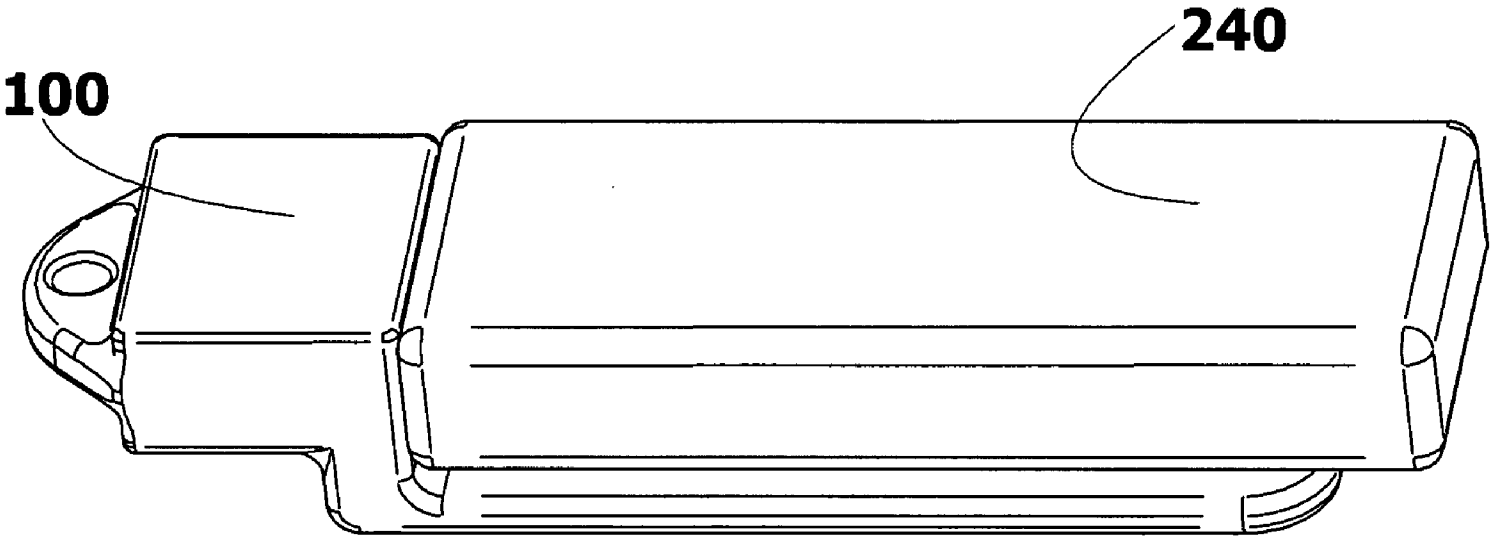
FIG. 10 is a bottom view of the extension element of the present invention attached to a USB flash memory device.

FIG. 8 shows the actual attachment of the USB cap of the present to a USB device 240. As shown, the USB device is inserted into the opening 210 of the cap body. When this insertion occurs, the main extension 102 slide over the USB device. The compatible shapes of the main extension 102 and the USB device facilitates the ease of insertion. FIG. 9 shows a side view of the USB cap of the present invention covering the USB device. This view shows an opening 242 between the surface of the USB device 240 and the main extension 102 of the present invention. FIG. 10 shows a three-dimensional bottom view of the cap of the present invention connected to the USB device 240.

While the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. The invention in its broader aspects is not limited to the specific details, representative apparatus and methods, and illustrative examples shown and described. Accordingly, departures may be made from such details without departing from the spirit or scope of the applicant's general inventive concept.

I claim:

1. A cap cover for a USB device comprising:

a cap body for covering a USB connector for a USB device, the cap body having front and back ends and top and bottom external surfaces said front end having an opening to facilitate the receipt of a USB connector for a USB device into the cap body, and a back end, the front opening having internal top and bottom surfaces and side surfaces, the cap body further comprising a handle extension extending from the back end of the cap body;

a front extension element, of substantially the same width as the USB connector, attached to said cap body and extending from the front end of said cap body, said front extension element having a top surface having substantially the same length and width as the front extension element for displaying various types of information, the front extension element having a front end that extends away from the cap body and a back end connected to the front end of the cap body; and guides that extend from the internal sides of the cap body into the opening, the guides capable of positioning and securing an inserted USB connector for a USB device into the cap body.

2. The cap cover as described in claim 1 further comprising a bridge section positioned between the top external surface of the cap body and the back end of the main extension.

3. The cap cover as described in claim 2 wherein said front end extension element has a shape that is consistent with a shape of a USB storage device that said cap cover will cover.

4. The cap cover as described in claim 3 wherein said front end extension element has a surface width that is at least the same width as the USB device.

5. The cap cover as described in claim 4 further comprising a cover material applied on the surface of the front end extension element.

6. The cap cover as described in claim 2 wherein said the cap cover is connected to a USB storage device such that an opening is created between the front extension element and a surface of the USB storage element.

7. A cap cover system for a USB storage device comprising:

a USB storage device having a base and a connector extending from the base;

a cap base for covering a USB connector for a USB device, the cap body having front and back ends and top and bottom external surfaces said front end having an opening to facilitate the receipt of a USB connector for a USB device into the cap base, and a back end, the front opening having internal top and bottom surfaces and side surfaces, the cap body further comprising a handle extension extending from the back end of the cap body;

a front extension element of substantially the same width as the USB connector attached to said cap base and extending from the front end of said cap base, said front extension having a top surface having substantially the same length and width as the front extension element for displaying various types of information, and front and back ends, the front extension having a front end that extends away from the cap base and a back end connected to the front end of the cap base; and guides that extend from the internal sides of the cap base into the opening, the guides capable of positioning and securing an inserted USB connector for a USB device into the cap base.

* * * * *